US005553704A

United States Patent [19]

Gordon et al.

[11] Patent Number: 5,553,704

[45] Date of Patent: Sep. 10, 1996

[54] STACKABLE CAN CARRIER

[75] Inventors: Robert L. Gordon, Monroe; Linda A. Bernstein, Campbell Hall, both of N.Y.

[73] Assignee: International Paper, Purchase, N.Y.

[21] Appl. No.: 321,199

[22] Filed: Oct. 11, 1994

[51] Int. Cl.[6] ..... B65D 75/00

[52] U.S. Cl. ..... 206/158; 206/147; 206/148; 206/153

[58] Field of Search ..... 206/139, 141, 206/145, 147, 148, 149, 152, 153, 156, 157, 158

[56] References Cited

U.S. PATENT DOCUMENTS

| | | | |
|---|---|---|---|
| 2,656,960 | 10/1953 | Camuth | 206/149 X |
| 3,156,358 | 2/1962 | Randrup . | |
| 3,302,364 | 11/1963 | Rice . | |
| 3,503,498 | 3/1970 | Lawrence | 206/152 X |
| 3,698,550 | 10/1972 | Graser . | |
| 3,722,945 | 3/1973 | Wood | 206/153 X |
| 3,913,739 | 10/1975 | Hennessey . | |
| 4,736,977 | 4/1988 | Killy | 206/148 X |
| 5,103,971 | 4/1992 | Schuster . | |
| 5,188,225 | 2/1993 | Jorba . | |
| 5,201,412 | 4/1993 | Schuster . | |
| 5,320,216 | 6/1994 | Pangborn . | |

*Primary Examiner*—Paul T. Sewell
*Assistant Examiner*—Tara L. Laster
*Attorney, Agent, or Firm*—Michael J. Doyle

[57] ABSTRACT

A stackable can carrier is formed from a unitary paperboard blank. The carrier compensates for stacking problems caused by smaller diameter tops and bottoms on present cans, the latter termed 202 cans which have a tendency to rock with respect to each other when stacked. An otherwise conventional can carrier is provided with foldable, lateral flaps having pairs of cuts lines which define ears. The latter are glued to the carrier top surface. The flaps overlie respective can top receiving openings in the carrier less than one half of the diameter of the can openings. Upon stacking of the carriers and cans therein for storage or for display, the carrier provides improved stability.

5 Claims, 3 Drawing Sheets

STACKABLE CAN CARRIER

BACKGROUND OF THE INVENTION

This invention relates to can carriers of the type formed from relatively stiff paperboard having a plurality of openings for receiving the tops of metal cans filled with potable liquids. The openings are usually provided with a plurality of radially extending fingers at their respective peripheries, the ends of the fingers engaging beneath the chimes of the metal cans.

In the past, the diameter of the chimes at the top and bottom of any can was substantially the same as the diameter of the can. Similarly, the area of the can top and can bottom was substantially the same as the transverse cross sectional area of the can. These can proportions caused no difficulty upon stacking filled cans in carriers.

The current industry trend in can manufacture is to reduce the top can diameter to a 202 size (2 2/16"). This reduction lowers cost since the top of cans with the common pull tab opening is the most expensive element of the construction. The lower ends of the cans are also reduced in diameter. The packaging industry is now having problems with this smaller diameter. The bottoms of the cans do not flatly nest into the 202 tops, causing unstable stacking in retail stores and during distribution. This new can-to-can nest resembles a shallow ball and socket fit with the result that there is a sliding or rocking between the ends of corresponding upper and lower aligned cans.

SUMMARY OF THE INVENTION

According to the practice of this invention an otherwise conventional flat paperboard panel can carrier, typically having six can top receiving openings, is provided with a flap along each of its longitudinal edges. Each flap is bent 180 degrees so that it overlies the top surface of the carrier panel and is parallel to this surface. Each flap has a free edge, with each free edge overlying and extending to about one third of the diameter of respective can top receiving openings. By this arrangement, the bottoms of aligned cans of an upper stacked can carrier contact the upper surface of respective flaps and are urged towards the center of the carrier. This action inhibits lateral sliding between the bottoms and tops of aligned cans and thus increases stability of a stack.

DETAILED DESCRIPTION OF THE INVENTION

Figure 1:
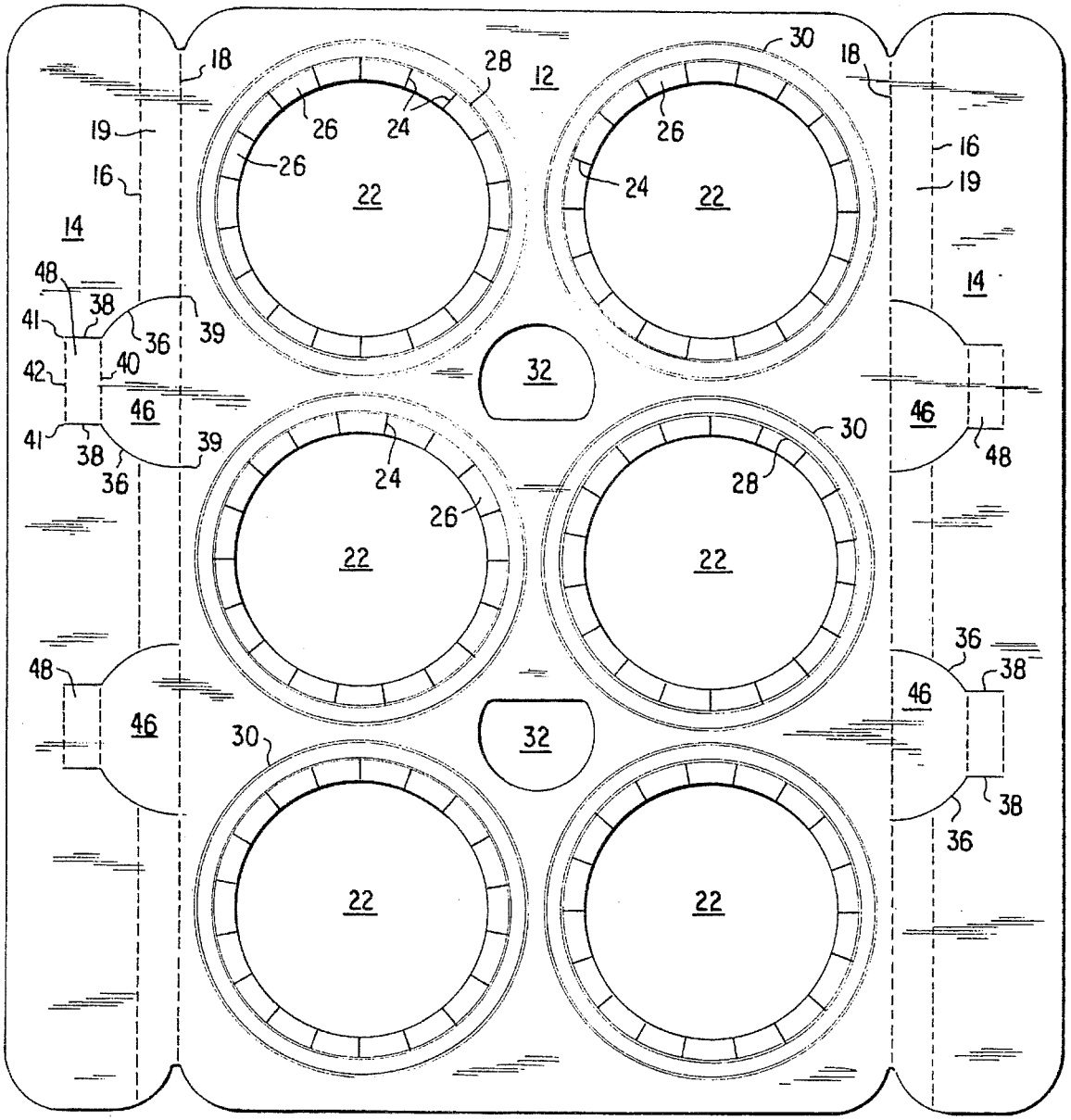
FIG. 1 is a top plan view of a unitary paperboard blank for forming the carrier of this invention.

Referring to FIG. 1, a generally rectangular paperboard blank is denoted as 10 and includes a central rectangular panel 12, termed a bottom panel, having a lateral rectangular flap 14 foldably connected to each longitudinal edge thereof by parallel fold lines 16 and 18, the area between the latter defining respective strips 19. A plurality of openings 22, usually symmetrically positioned, is formed in panel 12 with each such opening having a periphery bordered by radially extending cut lines 24 which in turn define radially extending resilient fingers 26. The tips of fingers 26 are adapted to engage beneath the chimes of metal cans, as is known. Circular debossments or indentations 28 define the outermost radial extent of fingers 26, and each of another set of circular indentations 30 also on the top surface is radially outwardly spaced from respective indentations 28. Finger receiving openings 32 serve as consumer carrying means for the carrier.

Each flap 14 is provided with pairs of spaced cuts 36,38. Cuts 36 are curved while cuts 38 are straight. Corresponding first terminal ends 39 of these cut lines terminate along fold lines 18 at the edges of panel 12. A primary fold line 40 extends between intermediate portions of each pair of cut lines 36 and 38, while a secondary fold line 42 extends between corresponding second terminal edges 41 of cut lines 36 and 38. Ears 46 are bordered by cuts 36, fold lines 18, and fold lines 40. Tabs 48 are located between cuts 38 and fold lines 40 and 42. It will be noted that cut lines 36 need not be curved, and that ears 46 can be rectangular.

Figure 2:
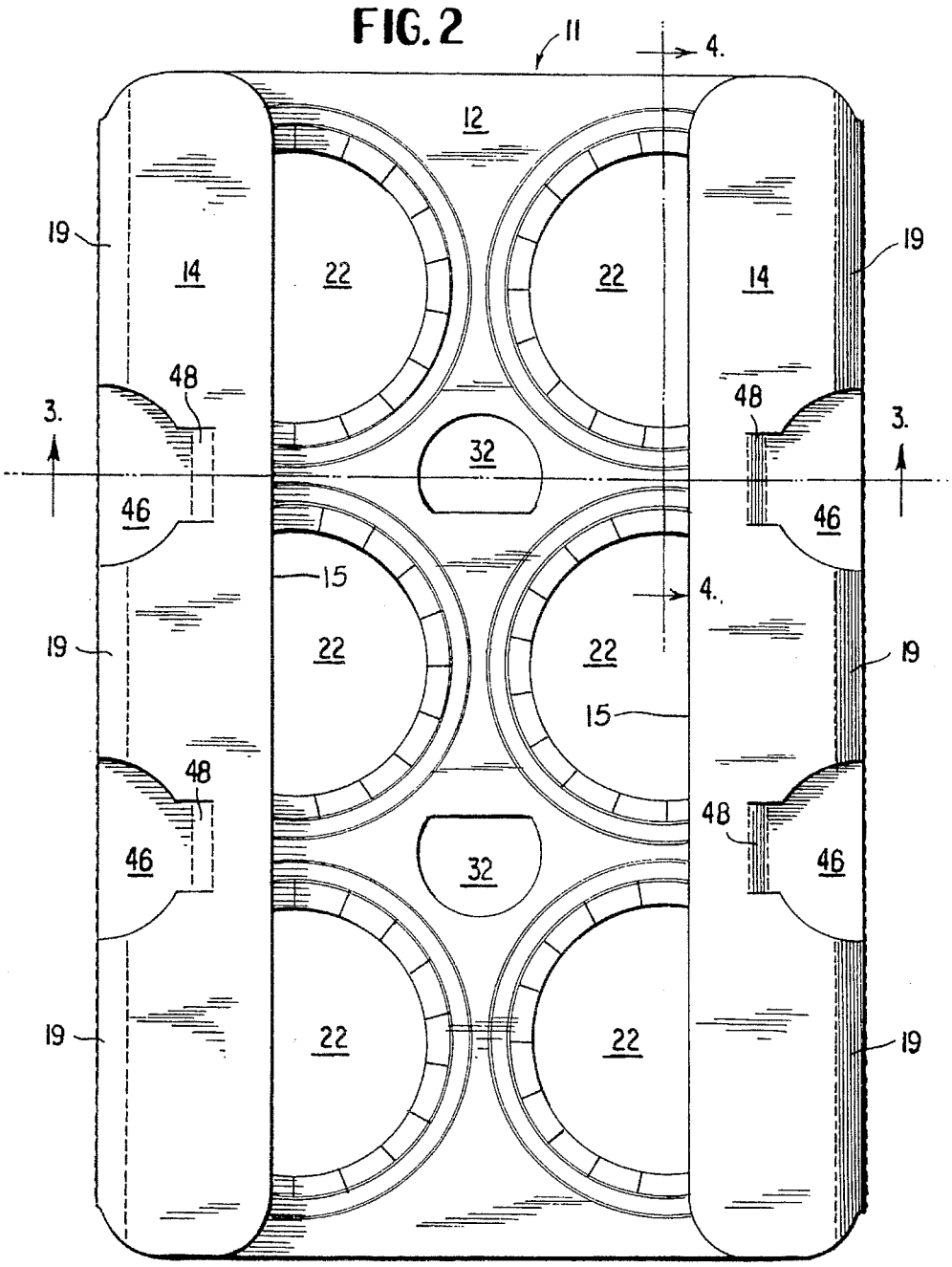
FIG. 2 is a top plan view of the blank of FIG. 1 after it has been folded to form the carrier of this invention.
Figure 3:
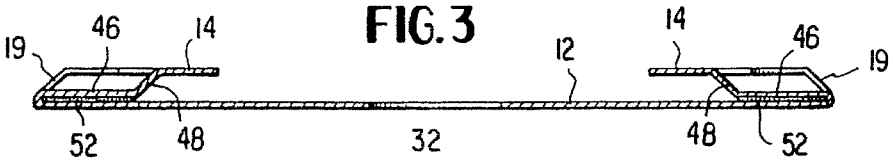
FIG. 3 is a view taken along section 3—3 of FIG. 2.
Figure 4:
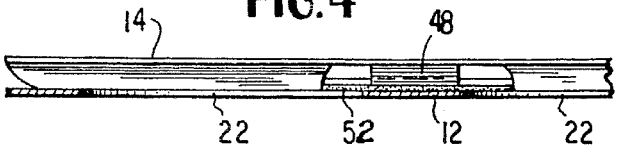
FIG. 4 is a view taken along section 4—4 of FIG. 2.

As shown at FIGS. 2 to 4, flaps 14 are folded over about fold lines 18, with ears 46 glued to the top surface of panel 12 by an adhesive 52 to form a completed carrier 11. Free edges 15 of flaps 14 extend over respective openings 22 by an extent less than one half of the opening diameters and preferably about one third. Before loading with cans and stacking, those portions of flaps 14 between fold lines 16 and the free edges 15 are substantially parallel to panel 12, as seen at FIG. 3. After the cans are loaded strips 19 and tabs 48 permit flaps 14 to lie parallel or flat by allowing for or compensating for the depth of the holding tabs. The primary function of ears 46 is to maintain flaps 14 substantially parallel to carrier main panel 12. After lading with cans, strips 19 and tabs 48 are substantially perpendicular to panel 12 and flaps 14.

Figure 5:
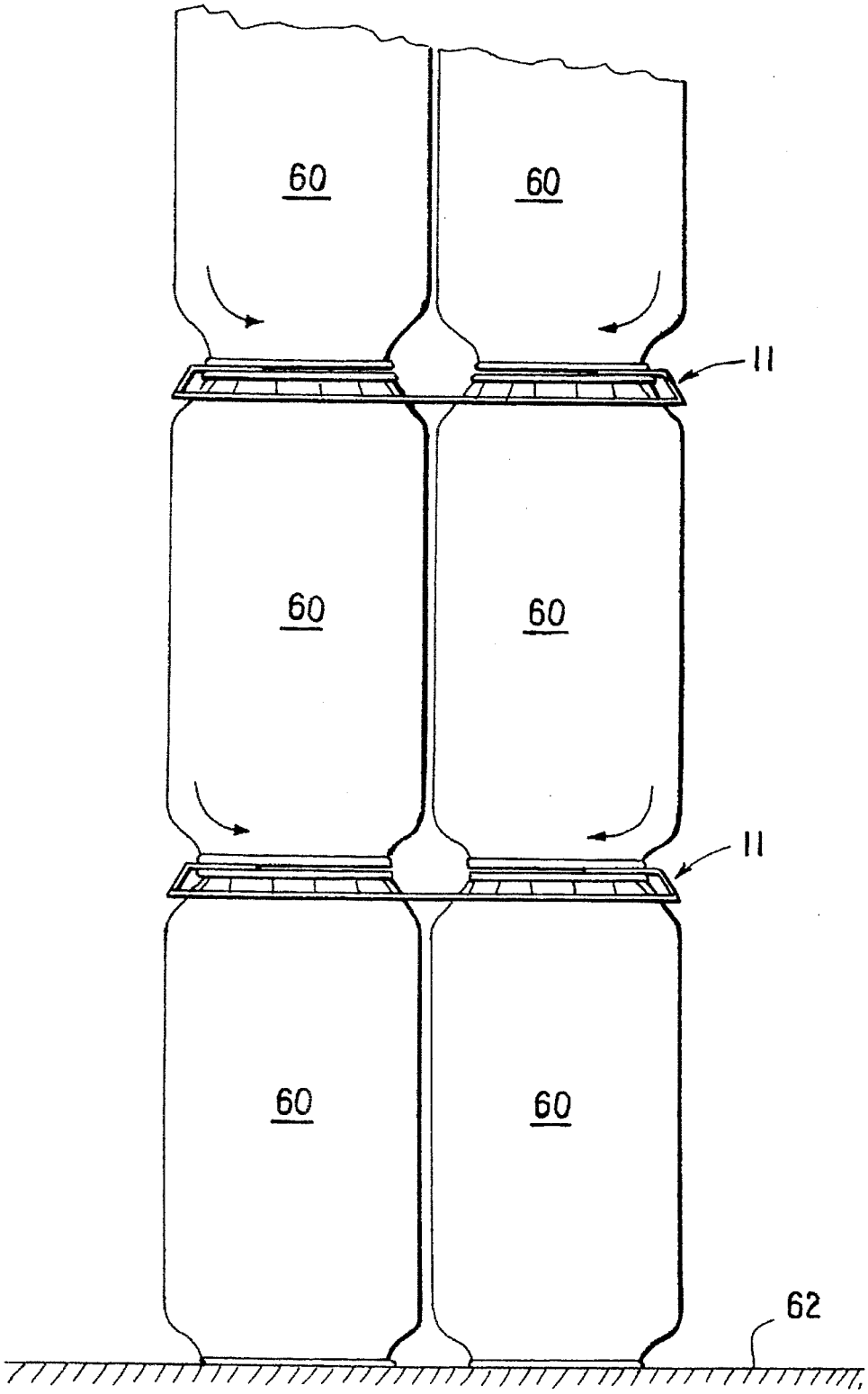
FIG. 5 is an end elevational view of a stack of cans, the tops of the cans being inserted into the carrier of this invention.

Upon loading the carriers with cans 60 and stacking the carriers on a support surface 62, as shown at FIG. 5, there is a tendency of each can 60 to tilt or slide towards the longitudinal center line (not shown) which passes through finger openings 32 of each panel 12, and thus tilt or slide towards an opposite can as indicated by the curved arrows. This action follows from the asymmetrical support given the bottom of each can by the overhanging flaps 14. Less than one half of the outermost of each can bottom, preferably the outermost one third, directly contacts and is supported by portions of flaps 14. The remaining, non flap supported bottom portions thus tilt or slide towards the carrier center. It is seen that the diameter of the chimes at the top of the cans is less than the diameter of the cans. FIG. 5 shows a slight gap between these can portions, as well as a slight gap between the can side walls, for illustrative purposes only. In practice these gaps would be smaller or would not exist. Without flaps 14, the bottom of any can 60, slightly smaller in diameter than shown at FIG. 5, would extend partially into the top region (bordered by and slightly below a chime) of a lower can and would be free to rock or swivel relative to the lower can. FIG. 5 is a view taken in the same direction as 3—of FIG. 2.

We claim:

1. A stackable can carrier formed from a unitary paperboard blank, said carrier having a generally flat bottom panel having an upper surface, said bottom panel having two opposed longitudinal edges, said bottom panel having a plurality of openings, each said opening having a periphery, each said periphery having resilient fingers for receiving chimes of individual cans, a flap at each of said opposed bottom longitudinal panel edges, each said flap being folded over said bottom panel upper surface so as to be substantially parallel thereto, each said flap having a free edge, each said flap having at least one pair of spaced cuts therethrough, each cut of each of said pairs of cuts having a corresponding first terminal end, a primary fold line extending between respective intermediate portions of each cut of each of said pairs of cuts, said cuts extending from said longitudinal edges of said bottom panel to a region of each of said flaps, a secondary fold line extending between corresponding second terminal ends of each cut of each of said pairs of cuts, said pairs of cuts each defining respective ears located between said respective longitudinal edges of said bottom panel and respective said primary fold lines, said ears being glued to said upper surface of said bottom panel, each said flap free edge overlying less than one half of a respective said bottom panel opening.

2. The can carrier of claim 1 including a can in each said bottom panel opening, each can having a chime at its upper portion, said resilient fingers of respective said openings engaging the chime of a respective can, the diameter of said chimes being less than the diameter of the cans.

3. The carrier and can construction of claim 2 including a second said can carrier with cans therein stacked on top.

4. A unitary paperboard blank for forming a stackable can carrier, said blank having a bottom panel having an upper surface, said bottom panel being generally rectangular and having two opposed longitudinal edges, said bottom panel having a plurality of openings, each said opening having a periphery, each said periphery having resilient fingers for engaging chimes of individual cans, a foldable flap extending laterally from each of said opposed longitudinal panel edges, each said flap having a free edge, each said flap having at least one pair of spaced cuts through said flap, each cut of each of said pairs of cuts having a corresponding first terminal end, a primary fold line extending between respective intermediate portions of each cut of each of said pairs of cuts, said cuts extending from said longitudinal edges of said bottom panel to a region of each of said flaps, a secondary fold line extending between corresponding second terminal ends of each cut of said pairs of cuts, said pairs of cuts defining respective ears located between said respective longitudinal edges of said bottom panel and respective said primary fold lines.

5. The blank of claim 4 including a finger receiving opening for carrying the carrier formed from the blank.

* * * * *